US005320242A

United States Patent [19]

Ramkissoon

[11] Patent Number: 5,320,242

[45] Date of Patent: Jun. 14, 1994

[54] WASTE SACK CONTAINER AND METHOD

[76] Inventor: Rone Ramkissoon, 5315 NW. 18th Pl., Lauderhill, Fla. 33313

[21] Appl. No.: 15,240

[22] Filed: Feb. 9, 1993

[51] Int. Cl.[5] ..... B65D 90/00

[52] U.S. Cl. ..... 220/404; 220/908; 248/97

[58] Field of Search ..... 220/404, 409, 908; 248/97

[56] References Cited

U.S. PATENT DOCUMENTS

| | | | |
|---|---|---|---|
| 2,951,628 | 9/1960 | Grussen | 229/55 |
| 3,249,285 | 5/1966 | Dollheimer et al. | 229/53 |
| 3,462,069 | 8/1969 | Suominen | 229/54 |
| 3,698,594 | 10/1972 | Boehlert | 220/404 |
| 4,393,910 | 7/1983 | Rasmussen | 150/12 |
| 4,576,310 | 3/1986 | Isgar et al. | 220/404 |
| 4,723,743 | 2/1988 | Jenkins | 220/404 X |
| 4,735,340 | 4/1988 | Preston | 220/404 |
| 4,763,808 | 8/1988 | Guhl et al. | 220/404 |
| 4,867,339 | 9/1989 | Hahn | 220/404 |
| 4,921,196 | 5/1990 | Rudko | 220/404 X |
| 4,923,087 | 5/1990 | Burrows | 220/404 |
| 4,946,118 | 8/1990 | Hastings | 220/908 X |
| 5,054,724 | 10/1991 | Hutcheson | 220/404 X |

*Primary Examiner*—Steven M. Pollard

*Attorney, Agent, or Firm*—Oltman and Flynn

[57] ABSTRACT

A container for receiving a removable liner sack includes a rectangular bottom wall, four side walls extending generally upward from the edges of the bottom wall and laterally encompassing and defining a space above the bottom wall, each having a side wall upper rim which collectively define an open container top, a side wall extension protruding generally upward beyond the upper rims of two opposing side walls and over which the liner opening is folded, the extension having a top edge and having a gap extending from the top edge generally toward the bottom wall to a point below the side wall upper rim, for inserting an object to engage and lift away the cuff portion for ease in removing and changing the liner sacks. Two opposing side wall extensions are preferably provided. The extensions are each preferably laterally shorter than the widths of the side walls to which they are joined. The liner sack cuff portion preferably abuts these side wall upper rims on either side of each extension, for preventing the cuff portion from extending below the upper rim. A method of removing a liner sack from the container includes the steps of fitting the object through the gap below the cuff portion and engaging the cuff portion with the object, and lifting the object along and out of the gap, thereby lifting the liner sack out of the container.

12 Claims, 3 Drawing Sheets

WASTE SACK CONTAINER AND METHOD

BACKGROUND OF THE INVENTION

1. Field of the Invention

The present invention relates generally to the field of vessels for containing waste and having finger gripping ports, and more specifically to a waste container for receiving a conventional plastic sack liner, the container having a rectangular bottom wall, four adjoining side walls extending generally upward from the bottom wall and laterally encompassing and defining a space above the bottom wall, the side walls each having an upper rim, these upper rims collectively defining an open container top, two opposing side walls each having an extension protruding generally upward beyond the upper rim and over which the liner opening edge is folded to form a cuff portion, the cuff portion abutting the upper rims of these two opposing side walls on either side of each extension, thereby preventing the cuff portion from extending below these upper rims, each of these extensions having a central gap of sufficient width to receive human finger and extending from the top edge of the extension downward to a point below these upper rims, for receiving a finger to grip and lift away the cuff portion for ease in removing and changing liners, the extensions optionally including finger holes on either side of each gap for gripping and lifting the container itself.

2. Description of the Prior Art

There have long been vessels for containing waste having openings for receiving fingers and thereby forming handle portions for securely gripping the vessel for lifting. These vessels have generally been plastic sacks. When these sacks are used as liners for stiff outer containers, however, the liner finger holes are typically obstructed by the container walls.

One such prior waste vessel is that of Dollheimer, U.S. Pat. No. 3,249,285, issued on May 3, 1966, which teaches a plastic bag including hand gripping holes. The bag is folded and heat sealed in any of several patterns at a closed bag end. Finger grip holes are punched through the folded portion so that multiple bag layers, together with the seal, help support the weight of the bag and its content when lifted. A problem with Finger if placed in a stiff outer vessel such as a waste basket or trash can is that the finger grip holes would be positioned at the closed bag end in the bottom of the container. Thus, these holes would be inaccessible for lifting the bag out of the container during bag replacement, which is when they would be most needed.

Suominen, U.S. Pat. No. 3,462,069, issued on Aug. 19, 1969, discloses a thermoplastic carrier bag having sleeves extending transversely, adjacent its mouth. An insert formed of a stiff material is fitted into each sleeve, which may serve two purposes. The insert may be imprinted with identifying marks identifying the bag contents or displaying a manufacturer's trademark. The insert may also include a finger hole for carrying the bag or for holding it open. A problem with Suominen if used within a stiff outer vessel is that the stiff inserts could make it difficult to cuff the edges of the bag opening over the rim of the vessel. Another problem is that, if the bag is cuffed over the vessel rim, the vessel wall would obstruct the finger holes.

Burrows, U.S. Pat. No. 4,923,087, issued on May 8, 1990, reveals a trash storage and disposal combination unit. The unit includes a stiff outer container having exterior hook elements on opposing sides and a plastic liner sack having cut out portions forming loops for fitting over the hook elements. In this way the sacks are held securely in the trash container, and can be gripped by their loops when sack removal is desired. A problem with Burrows is that only sacks specially designed for the combination unit would work as intended. No other plastic liner sacks on the market today would properly engage the hook elements. Another problem is that the protruding hook elements could injure and tear clothing of people brushing against the container.

Rasmussen, U.S. Pat. No. 4,393,910, issued on Jul. 19, 1983, teaches a flexible container for lifting, transport and storage, having four lifting loops. The lifting loops are extensions of the container's side walls. A problem with Rasmussen if used as a liner for a stiff vessel is that the vessel wall would obstructed the lifting loops and prevent easy gripping.

Grussen, U.S. Pat. No. 2,951,628, issued on Sep. 6, 1960, teaches a container for fluid or pulverulent material and a process for making the container. The container has an L-shaped weld line dividing a small portion of the container interior from the remainder of the interior. Two semi-rigid sheets cover portions of the container and a handle opening is cut in the sides through the small portion. A problem with Grussen is that the container is not shaped to function as a liner for an outer vessel and would be more expensive to manufacture than most such liners. On the other hand, Grussen does not appear sufficiently rigid to function itself as an outer vessel. Also, if Grussen were used as an outer vessel, a liner fit inside could not be easily grasped for removal.

Preston, U.S. Pat. No. 4,735,340, issued on Apr. 5, 1988, discloses liner bag brackets for fitting over and engaging the rim of a trash receptacle. Loops of a plastic liner bag fit over and are hooked in position by projections on the brackets. The problems presented by Preston are essentially the same as those presented by Burrows.

It is thus an object of the present invention to provide a waste container which can receive a removable liner sack and which permits easy and secure gripping of such a liner sack for periodic removal and replacement.

It is another object of the present invention to provide such a waste container which can accept ordinary generic trash bags as liner sacks.

It is still another object of the present invention to provide such waste container which has no protruding parts which could cause injury or damage to clothing.

It is finally an object of the present invention to provide such a waste container which is simple in design and inexpensive to manufacture.

SUMMARY OF THE INVENTION

The present invention accomplishes the above-stated objectives, as well as others, as may be determined by a fair reading and interpretation of the entire specification.

A container is provided for receiving a removable liner sack, including a bottom wall, a side wall extending generally upward from the bottom wall and laterally encompassing and defining a space above the bottom wall, having a side wall upper rim defining an open container top, a side wall extension protruding generally upward beyond the upper rim and over which the liner opening is folded, the extension having a top edge and having a gap extending from the top edge generally toward the bottom wall to a point below the side wall upper rim, for inserting an object to engage and lift away the cuff portion for ease in removing and changing the liner sacks. Two opposing side wall extensions are preferably provided. The extensions are each preferably laterally shorter than the diameter of the upper rim. The liner sack cuff portion preferably abuts the upper rim between the extensions, for preventing the cuff portion from extending below the upper rim. The gap is preferably centrally located in the extension, and is preferably of sufficient width to receive a human finger. The object to engage is also preferably a human finger. A finger receiving hole is optionally provided in the extension, beside the gap for gripping and lifting the container. One finger receiving hole is preferably provided on either side of the gap.

A second embodiment of the container is provided wherein the bottom wall is quadrilateral-shaped, including four side walls, each side wall extending generally upward from an edge of the bottom wall. The extensions preferably extend generally upward from two opposing side walls and each extension is preferably shorter in length than the width of the side wall to which it adjoins.

A method of removing a liner sack from the container is provided, including the steps of fitting the object through the gap below the cuff portion and engaging the cuff portion with the object, and lifting the object along and out of the gap, thereby lifting the liner sack out of the container.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
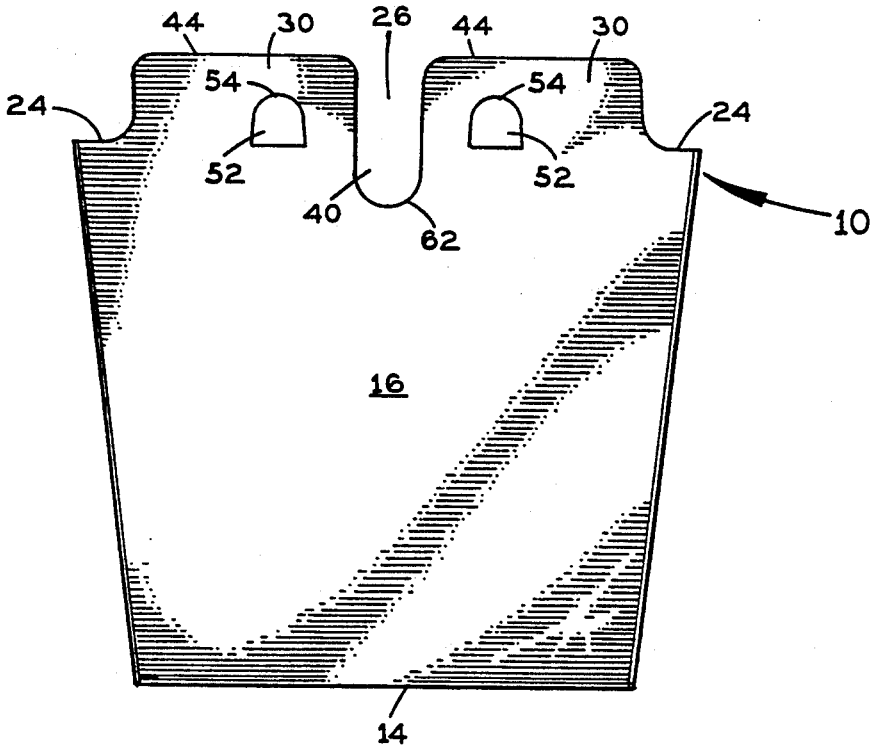
FIG. 1 is a side projection view of the first preferred embodiment of the inventive waste container, showing one of the extensions, the gap in the extension, and the optional extension finger holes.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

FIRST PREFERRED EMBODIMENT

Figure 2:
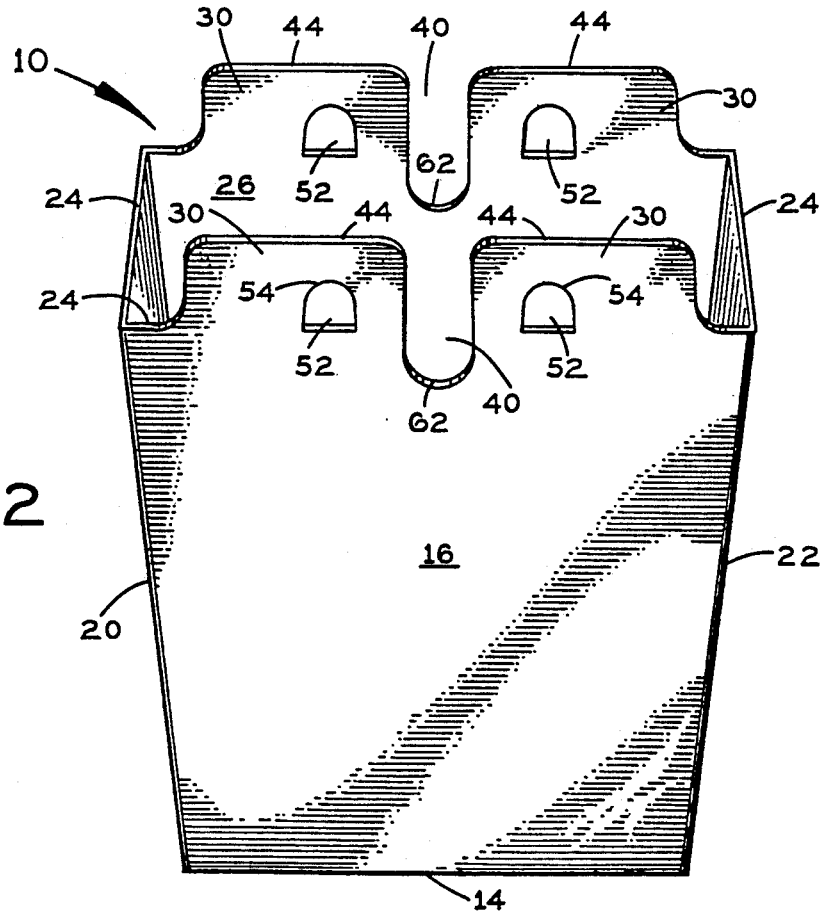
FIG. 2 is a perspective view of the inventive waste container as in FIG. 1.

Referring to FIGS. 1 and 2, a waste container 10 is disclosed for receiving a plastic liner sack 12 such as a conventional plastic waste sack or trash bag. Container 10 has a rectangular bottom wall 14, two opposing narrower side walls 16 and 18 and two opposing wider side walls 20 and 22. Side walls 16, 18, 20 and 22 extend generally upward from the outer edge of bottom wall 14, and laterally encompass and define a space above bottom wall 14. Side walls 16, 18, 20 and 22 each have an upper rim 24, and these upper rims 24 collectively form a common rim defining an open container top 26.

Figure 3:
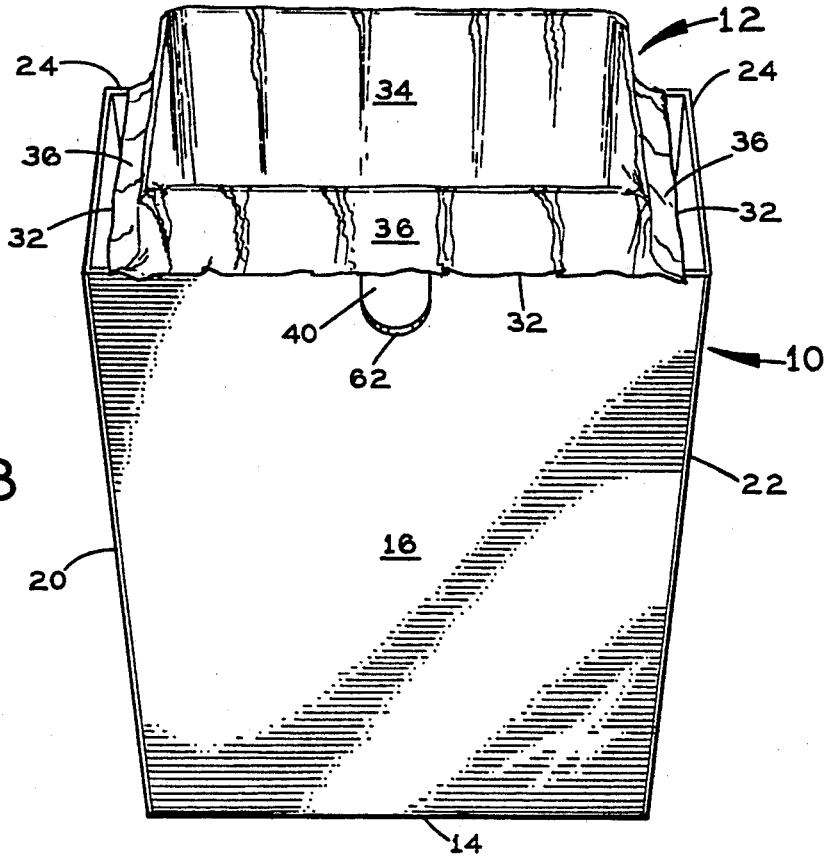
FIG. 3 is a perspective view as in FIG. 2, fitted with a liner sack, showing how extensions which are shorter than the widths of the opposing side walls to which they are joined cause the side wall upper rims to support the liner cuff portion and hold it above the level of the gap lower ends.

A side wall extension 30 protrudes generally upward from each narrower side wall 16 and 18, beyond their respective upper rims 24, and are each preferably an integral continuation of each side wall 16 and 18. Extensions 30 are each shorter in length than the width of side walls 16 and 18. The edge 32 of the liner sack mouth 34 is folded over both extensions 30 to form a cuff portion 36. Cuff portion 36 abuts the upper rims 24 of side walls 16 and 18 on either side of each extension 30, thereby preventing cuff portion 36 from extending below rims 24. See FIG. 3. Each extension 30 has a central gap 40 of sufficient width to receive a human finger which extends from the top edge 44 of each extension 30 downward to a point below the level of upper rims 24. Gaps 40 are provided for receiving finger below cuff portion 36 to enable the user to grip and lift cuff portion 36 and liner 12 when changing liners 12.

Extensions 30 each optionally include a finger hole 52 on either side of gap 40 for gripping and lifting waste container 10 itself. The upper edges 54 of finger holes 52 are preferably curved upward to better fit the curvature of a human finger. The bottom edge 62 of each gap 40 is preferably curved downward for the same reason. The corners of each extension 30 are preferably rounded so that they do not puncture and tear liner sacks 12.

SECOND PREFERRED EMBODIMENT

Figure 4:
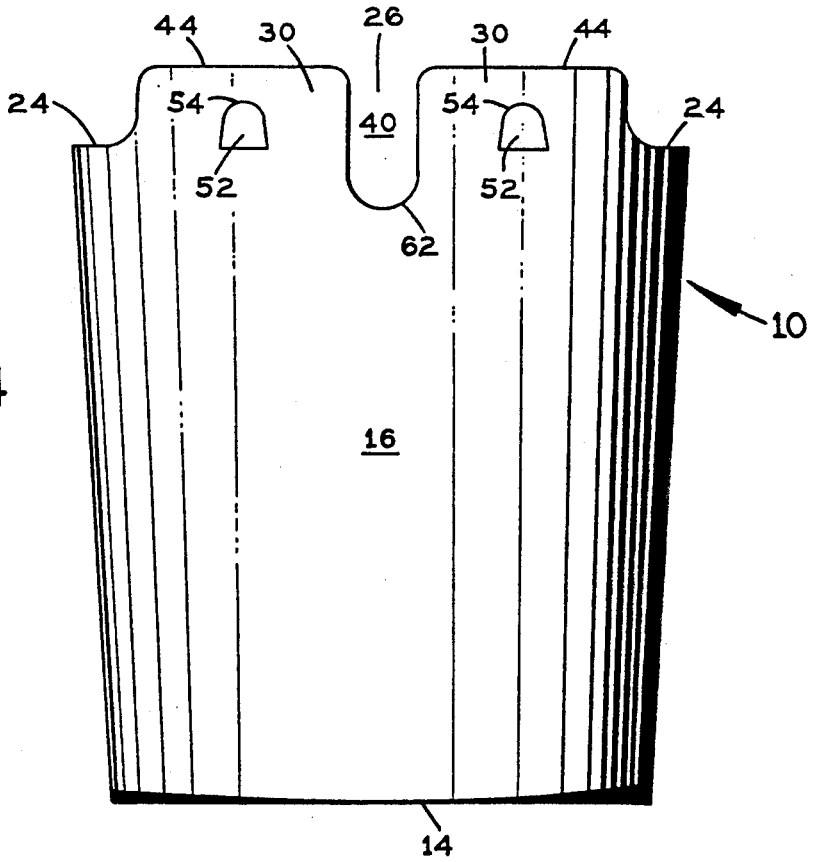
FIG. 4 is a side projection view of the second embodiment of the inventive waste container, wherein the bottom wall is essentially circular and a single side wall forms a continuous loop, showing one of the extensions, the gap in the extension, and the optional extension finger holes.
Figure 6:
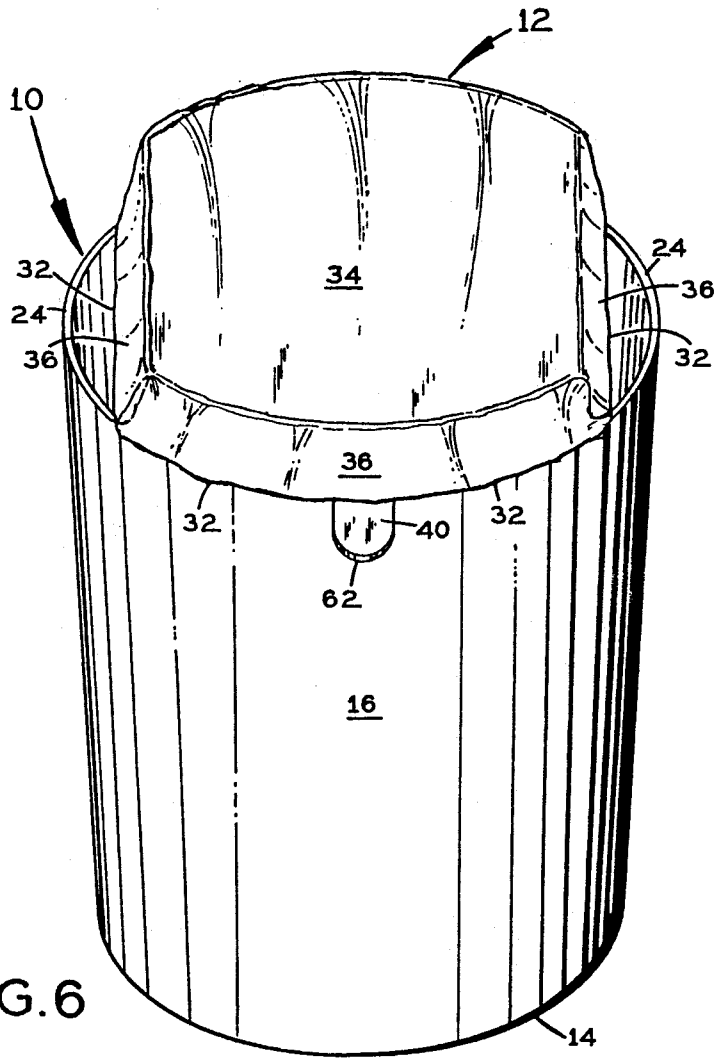
FIG. 6 is a perspective view as in FIG. 5, fitted with a liner sack, showing how extensions which are shorter than the diameter of the container upper rim cause the upper rim to support the liner cuff portion and hold it above the level of the gap lower ends.
Figure 5:
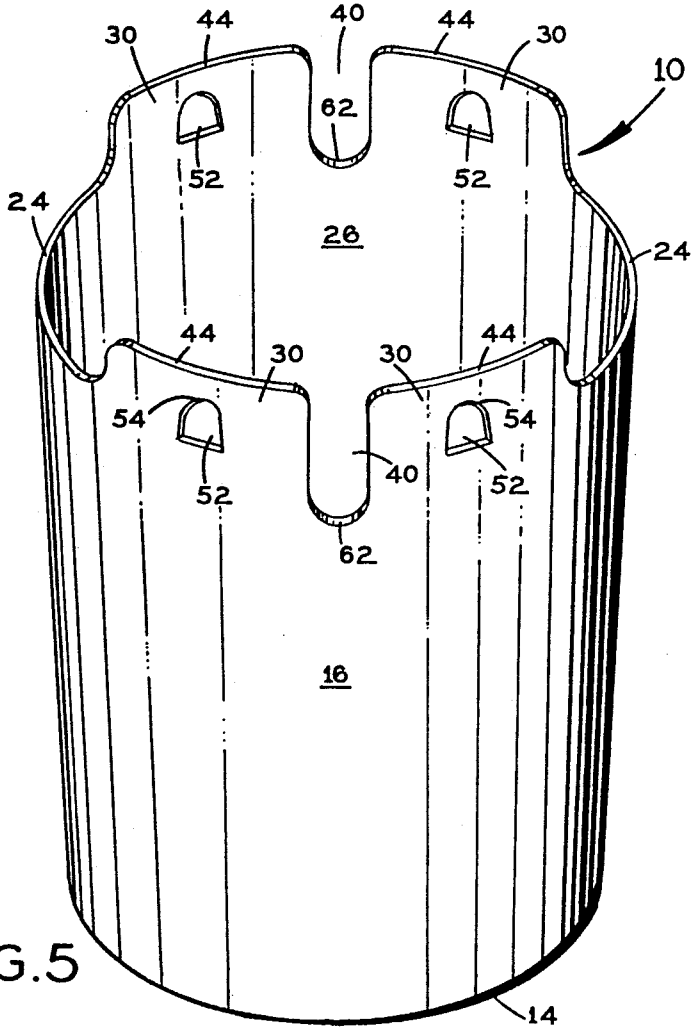
FIG. 5 is a perspective view of the inventive waste container as in FIG. 4.

The second preferred embodiment is like the first except for the following equivalent variations. Bottom wall 14 is circular or oval-shaped, and has a single continuous side wall 16 extending generally upward from its perimeter. See FIGS. 4, 5 and 6. The upper edge of side wall 16 comprises a single container upper rim 24. Extensions 30 are positioned on upper rim 24 to in diametric opposition to each other. Each extension 30 is shorter in length than the diameter of upper rim 24, so that cuff portion 36 abuts portions of upper rim 24 bowing outward between extensions 30. See FIG. 6.

METHODS

In practicing the invention, the following method may be used. The user's fingers are fitted through gaps 40 and hooked under cuff portion 36. Then the user's fingers are moved upward along and out of gaps 40, thereby lifting liner sack 12 from container 10. A hook or other tool equivalently may be used to engage cuff portion 36.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A waste sack container, comprising:

a liner sack comprising a liner sack side portion and a liner sack opening having a sack edge, said sack edge being folded back over said liner sack side portion to form a liner sack outer cuff portion, a container bottom wall, a container side wall extending generally upward from said container bottom wall and laterally encompassing and defining a space above said container bottom wall, having a container side wall upper rim defining an open container top, a cuff supporting container side wall extension protruding generally upward beyond said container upper rim and over which said cuff portion of said liner sack is fitted, so that said sack edge extends above and across said container side wall upper rim and across said open container top adjacent said side wall extension for keeping said cuff portion from engaging said container side wall for unrestricted liner sack removal, said side wall extension having a top edge and having a gap extending from said top edge generally toward said container bottom wall to a point below said container side wall upper rim, for inserting an object to engage and lift away said cuff portion for ease in removing and replacing said liner sack.

2. A container according to claim 1, wherein two opposing said side wall extensions are provided.

3. A container according to claim 2, wherein said upper rim is essentially circular.

4. A container according to claim 2, wherein said extensions are each laterally shorter than the diameter of said upper rim.

5. A container according to claim 2, wherein said bottom wall is quadrilateral-shaped, comprising four said side walls, each said side wall extending generally upward from an edge of said bottom wall.

6. A container according to claim 5, wherein said extensions extend generally upward from two opposing said side walls and each said extension is shorter in length than the width of the side wall to which it adjoins.

7. A container according to claim 3, where said liner sack cuff portion abuts said container upper rim between said extensions, for preventing said cuff portion from extending below said upper rim.

8. A container according to claim 1, wherein said gap is centrally located in said extension.

9. A container according to claim 1, wherein said gap is sufficient width to receive a human finger.

10. A container according to claim 9, wherein said object to engage is a human finger.

11. A container according to claim 1, additionally comprising a finger receiving hole in said extension, beside said gap for gripping and lifting said container.

12. A container according to claim 11, wherein one said finger receiving hole is provided on either side of said gap.

* * * * *